US008409035B1

(12) United States Patent
Guyer

(10) Patent No.: US 8,409,035 B1
(45) Date of Patent: Apr. 2, 2013

(54) METHOD OF PLAYING A FIELD GAME

(75) Inventor: Reynolds W. Guyer, Boca Grande, FL (US)

(73) Assignee: Winsor Fun, LLC, St. Paul, MN (US)

( * ) Notice: Subject to any disclaimer, the term of this patent is extended or adjusted under 35 U.S.C. 154(b) by 0 days.

(21) Appl. No.: 12/573,565

(22) Filed: Oct. 5, 2009

Related U.S. Application Data

(63) Continuation-in-part of application No. 29/344,699, filed on Oct. 2, 2009, now Pat. No. Des. 648,404.

(60) Provisional application No. 61/102,525, filed on Oct. 3, 2008.

(51) Int. Cl.
*A63B 71/02* (2006.01)

(52) U.S. Cl. ..... 473/415; 473/465

(58) Field of Classification Search ..... 473/415, 473/465, 468, 416, 490; 273/317, 118 R, 273/127 A
See application file for complete search history.

(56) References Cited

U.S. PATENT DOCUMENTS

| | | | | | |
|---|---|---|---|---|---|
| 74,022 | A | * | 2/1868 | Wheat | 273/118 R |
| 95,969 | A | | 10/1869 | Barlow | |
| 169,751 | A | | 11/1875 | Wallie | |
| 269,351 | A | * | 12/1882 | Turner | 273/127 A |
| D29,710 | S | | 11/1898 | Schlaebitz | |
| 991,523 | A | | 5/1911 | McClay | |
| 1,265,085 | A | | 5/1918 | Ishida | |
| D58,790 | S | | 8/1921 | McGee | |
| 1,405,988 | A | | 2/1922 | Erwin | |
| 2,366,782 | A | * | 1/1945 | Gorsuch | 273/127 B |
| D154,199 | S | | 6/1949 | Finkelstein | |
| 2,520,392 | A | * | 8/1950 | Flenghi | 473/103 |
| D171,286 | S | | 1/1954 | Ohme | |
| 3,024,024 | A | * | 3/1962 | Chalcroft | 473/468 |
| 3,406,973 | A | * | 10/1968 | Poole | 273/123 R |
| D213,127 | S | | 1/1969 | Schork, Jr. | |
| 3,730,527 | A | | 5/1973 | Nelson | |
| 3,801,104 | A | | 4/1974 | Potts et al. | |
| D231,844 | S | | 6/1974 | Singleton | |
| 3,931,973 | A | | 1/1976 | Moe | |
| 3,964,748 | A | | 6/1976 | Harvey, Jr. | |
| 4,056,268 | A | | 11/1977 | Connor et al. | |
| 4,057,252 | A | | 11/1977 | Pelton | |
| D250,360 | S | | 11/1978 | Shone | |
| 4,179,122 | A | | 12/1979 | Ray | |
| 4,229,004 | A | | 10/1980 | Stokes | |

(Continued)

OTHER PUBLICATIONS

Design #3018391 Bibliography, printed from www.ipo.gov.uk, Jul. 16, 2011, 6 pages.

*Primary Examiner* — Mitra Aryanpour
(74) *Attorney, Agent, or Firm* — James L. Young; Westman, Champlin & Kelly, P.A.

(57) ABSTRACT

The field game is played using the following game components: a first and second set of game balls, first and second sets of shorter game towers, first and second taller game towers and first and second ball-striking mallets, with such first and second game components bearing separate indicia for identifying them as the components of first and second teams, respectively. Boundaries for game play on a playing surface are established by using spaced apart markers and spaced apart taller game towers. The remaining game components are then disposed within those boundaries and play is begun by teams taking alternative turns at striking their own balls, while attempting to contact the balls of the opposing team or the towers of the opposing team, to knock those towers over.

20 Claims, 5 Drawing Sheets

U.S. PATENT DOCUMENTS

| | | | | | |
|---|---|---|---|---|---|
| 4,248,428 | A | * | 2/1981 | Vilches | 473/468 |
| 4,261,570 | A | * | 4/1981 | Switzer | 273/127 B |
| 4,295,650 | A | | 10/1981 | Keeble | |
| D261,873 | S | | 11/1981 | Marchand | |
| 4,339,133 | A | | 7/1982 | Warehime | |
| 4,453,713 | A | | 6/1984 | Guyer | |
| 4,480,838 | A | | 11/1984 | Aharonian | |
| 4,526,368 | A | | 7/1985 | Furda | |
| 4,767,117 | A | | 8/1988 | Maio | |
| 4,790,534 | A | | 12/1988 | Jamison | |
| 4,856,780 | A | | 8/1989 | Begley et al. | |
| 4,878,671 | A | | 11/1989 | Gubany | |
| 4,991,855 | A | | 2/1991 | Hazlewood | |
| 5,029,863 | A | | 7/1991 | Krawczyk et al. | |
| 5,060,956 | A | | 10/1991 | Glass | |
| 5,188,358 | A | | 2/1993 | Glass | |
| 5,201,519 | A | | 4/1993 | Sorteberg | |
| 5,366,220 | A | | 11/1994 | Harper | |
| D357,043 | S | | 4/1995 | Turner | |
| 5,465,962 | A | * | 11/1995 | Hiserman | 273/118 R |
| 5,472,211 | A | | 12/1995 | McCaughan | |
| 5,516,108 | A | | 5/1996 | Foster et al. | |
| 5,556,093 | A | | 9/1996 | Lankiewicz et al. | |
| 5,692,979 | A | | 12/1997 | Jones | |
| D389,871 | S | | 1/1998 | Young | |
| 5,735,749 | A | | 4/1998 | Charbel et al. | |
| 5,860,648 | A | | 1/1999 | Petermeier et al. | |
| 5,931,465 | A | | 8/1999 | Miyake et al. | |
| 5,984,307 | A | | 11/1999 | Fontana | |
| 6,142,884 | A | | 11/2000 | Yim | |
| 6,513,807 | B1 | | 2/2003 | Lynch | |
| 6,695,722 | B2 | * | 2/2004 | Butler | 473/415 |
| 7,104,902 | B2 | * | 9/2006 | Dopson | 473/465 |
| 7,121,963 | B2 | | 10/2006 | Corbin et al. | |
| 7,134,661 | B2 | | 11/2006 | Trecartin | |
| 7,338,047 | B2 | * | 3/2008 | Kelley et al. | 273/317 |
| D609,755 | S | | 2/2010 | Jones | |
| D632,601 | S | | 2/2011 | Bell | |
| 2002/0109297 | A1 | | 8/2002 | Beam | |
| 2002/0111232 | A1 | * | 8/2002 | Vujcuf | 473/415 |
| 2004/0082402 | A1 | | 4/2004 | Unosawa | |
| 2004/0106464 | A1 | | 6/2004 | Lin | |
| 2004/0160011 | A1 | | 8/2004 | Fitzgerald | |
| 2004/0220001 | A1 | | 11/2004 | Oister et al. | |
| 2005/0104295 | A1 | * | 5/2005 | Buckfield | 273/317 |
| 2005/0115849 | A1 | | 6/2005 | Nally | |
| 2006/0154225 | A1 | | 7/2006 | Kim | |
| 2006/0287030 | A1 | | 12/2006 | Briggs et al. | |
| 2008/0122170 | A1 | | 5/2008 | Ruddell | |
| 2008/0254846 | A1 | | 10/2008 | Magers et al. | |
| 2009/0093324 | A1 | | 4/2009 | Payer | |

* cited by examiner

METHOD OF PLAYING A FIELD GAME

CROSS-REFERENCE TO RELATED APPLICATION

The present application is based on and claims the benefit of U.S. provisional patent application Ser. No. 61/102,525, filed Oct. 3, 2008, and U.S. design patent application Ser. No. 29/344,699, filed Oct. 2, 2009, the contents of which are hereby incorporated by reference in their entireties.

This disclosure is directed to a game played on a surface such as a lawn, park area, or even indoors such as on carpeting or another surface.

SUMMARY

This disclosure is directed to a method for playing a game played by a first team and a second team. The game components for practicing this method comprise first and second sets of game balls, wherein each set has the same number of balls and the balls of each set bear indicia specific to its respective team. The game also comprises first and second sets of shorter game towers, wherein each set has the same number of shorter towers and the shorter towers of each set bear indicia specific to its respective team, and first and second taller game towers wherein each taller tower bears indicia specific to its respective team. The game also comprises first and second ball-striking mallets, wherein each mallet bears indicia specific to its respective team. The method for playing the game comprises selecting a playing surface for the game, defining a boundary between two spaced apart markers on the playing surface, disposing the taller game towers on the playing surface at points spaced equally from each side of the boundary line and between the two markers, thereby forming a triangular first team set-up territory defined by the two markers and the first taller tower and a triangular second team set-up territory defined by the two markers and the second taller tower, whereby the first and second triangular set-up territories are generally mirror images of one another in size and layout. The game further comprises placing the first set of balls and the first set of shorter towers on the playing surface within the triangular first set-up territory, placing the second set of balls and the second set of shorter towers on the playing surface within the triangular second set-up territory, and taking alternative team game play turns until a game winner is declared, whereby each turn comprises a player on a team attempting to strike one of that team's balls with that teams mallet in an attempt to contact one of the other's team's balls or towers. The method of playing the game provides several possible outcomes for each turn, including:

(1) the player striking that player's game ball receives another turn when the struck ball contacts and knocks over one of the other team's shorter towers, and as a consequence, the contacted shorter tower is removed from the playing surface, (2) that player's turn is over when any one of the following events occurs:

(a) prior to removal of all the other team's shorter towers from the playing surface, the struck ball fails to contact and knock over one of the other team's shorter towers, and (b) after removal of all other team's shorter towers from the playing surface, the struck ball fails to contact and knock over the other team's taller tower, (3) the game is over and that player's team is declared winner of that game when any one of the following events occurs:

(a) once all of the other team's shorter towers have been removed from the playing surface, the struck ball contacts and knocks over the other team's taller tower, and (b) once all but one remaining ball of the other team's balls have been removed from the playing surface, the struck ball contacts the other team's one remaining ball, and (4) the game is over and the other team is declared the winner when any one of the following events occurs:

(a) prior to removal of all of the other team's shorter towers from the playing surface, the struck ball contacts and knocks over the other team's taller tower, and (b) the struck ball contacts and knocks over its own team's taller tower.

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

Figure 1:
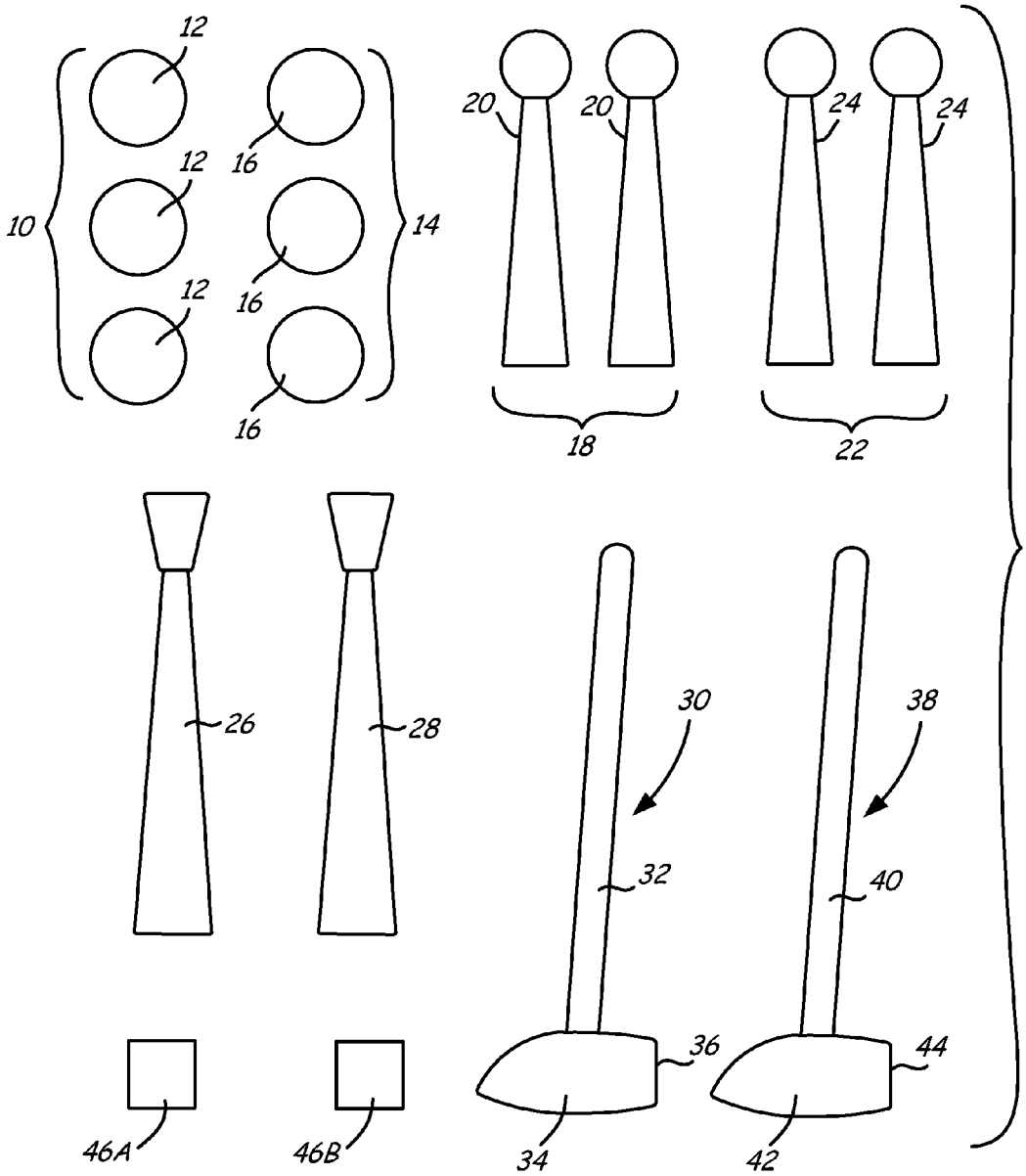
FIG. 1 is a schematic view of game components for use in playing the game.

While the above-identified figures sets forth one exemplary embodiment of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The disclosed game components and method of play for a game using those components are intended to create a game focused on offensive play and entertainment. The disclosed game is intended to be played by two teams. The two teams take turns trying to knock over all of the other team's towers or trying to knock out all of the other team's balls.

In one embodiment, the game components comprise a first set 10 of game balls 12 and a second set 14 of game balls 16. In one embodiment, the first set 10 of game balls 12 are all of one color (e.g., red) thus identifying them as specific to one team (i.e., a first team), and the second set of balls 14 are all of one color (e.g., white) to identify those balls as the balls of another team (i.e., a second team). The balls 12 and 16 are generally identical in size and weight, other than differing in color or in some other indicia identifying them as balls of the respective first and second teams. In one embodiment, each ball is approximately 2.75 inches in diameter.

Figure 2A:
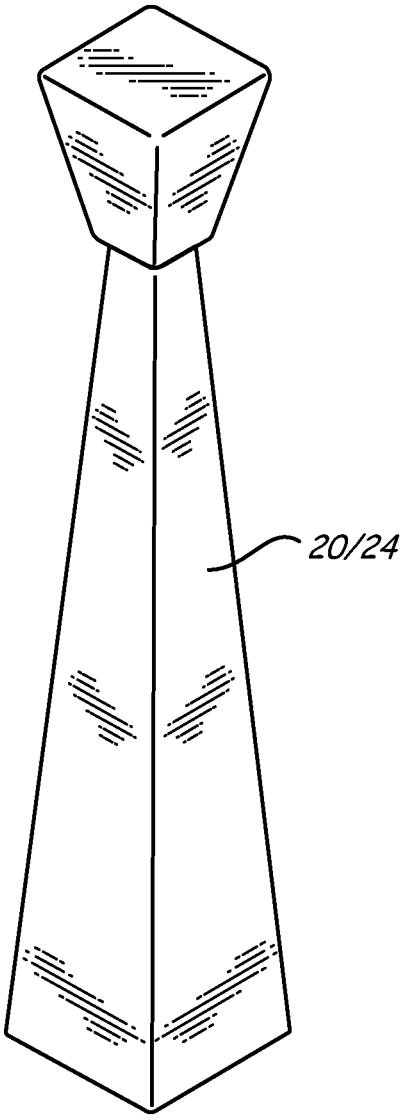
FIGS. 2A and 2B are isometric and side views, respectively, of a shorter game tower for use in playing the game.
Figure 2B:
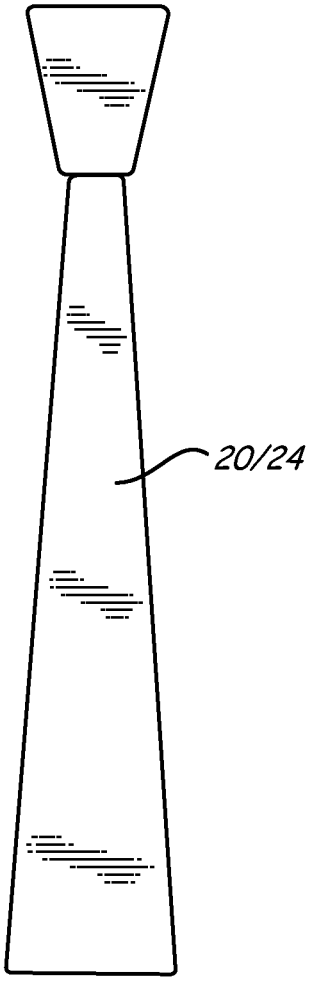

A first set 18 of identical shorter game towers 20 is also provided. The first set 18 of shorter game towers is likewise colored to identify those towers with the first team (e.g., each tower 20 is red). A second set 22 of shorter game towers 24 is further provided. The second set 22 of shorter game towers is likewise colored to identify those towers with the second team (e.g., each tower 24 is white). An exemplary configuration for shorter game towers used in the game is illustrated in FIGS. 2A and 2B. The shorter game towers 20 and 24 are generally identical in size, configuration, and weight, other than being of different colors to identify them with their respective teams, or bearing some other identifying indicia for that purpose. In one embodiment, each shorter game tower is approximately 11 inches tall. During play of the game, the shorter game towers may be referred to as "soldiers" or "pawns."

Figure 3A:
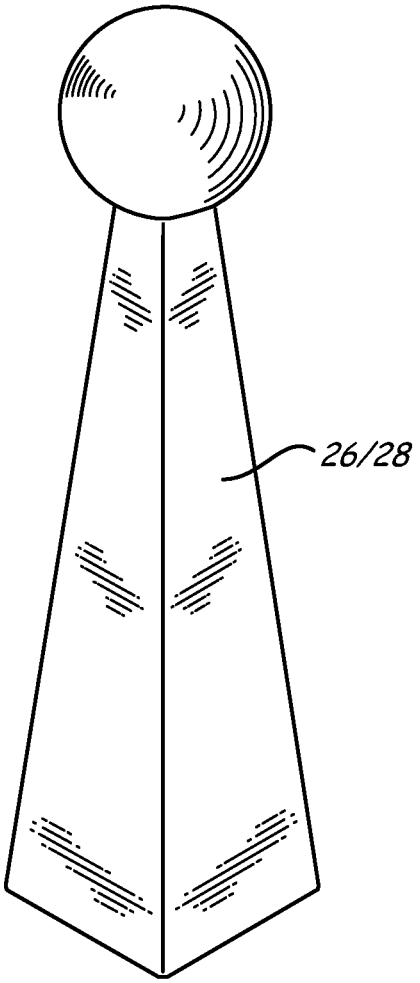
FIGS. 3A and 3B are isometric and side views, respectively, of a taller game tower for use in playing the game.
Figure 3B:
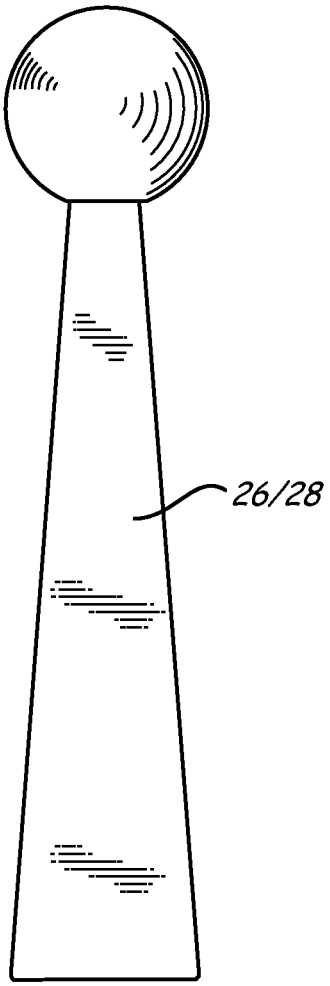

A first taller game tower 26 is provided for the first team. In one embodiment, the first taller game tower 26 is likewise colored (e.g., red) or bears indicia to identify it as associated with the first set 18 of shorter game towers 20 and first set 10 of balls 12 of the first team. A second taller game tower 28 is also provided for the second team. The second taller game tower 28 is generally identical to the first game tower 26 in height, configuration, and weight, although it differs in color (e.g., being white) or in some other indicia which indicates that it is associated with the second set 22 of shorter game towers 24 and the second set 14 of game balls 16 of the second team. An exemplary configuration of the taller towers for use in the game is illustrated in FIGS. 3A and 3B. In one embodiment, the first and second game towers each has a height of approximately 13.5 inches. During play of the game, the taller towers may be referred to as "kingpins."

Figure 4:
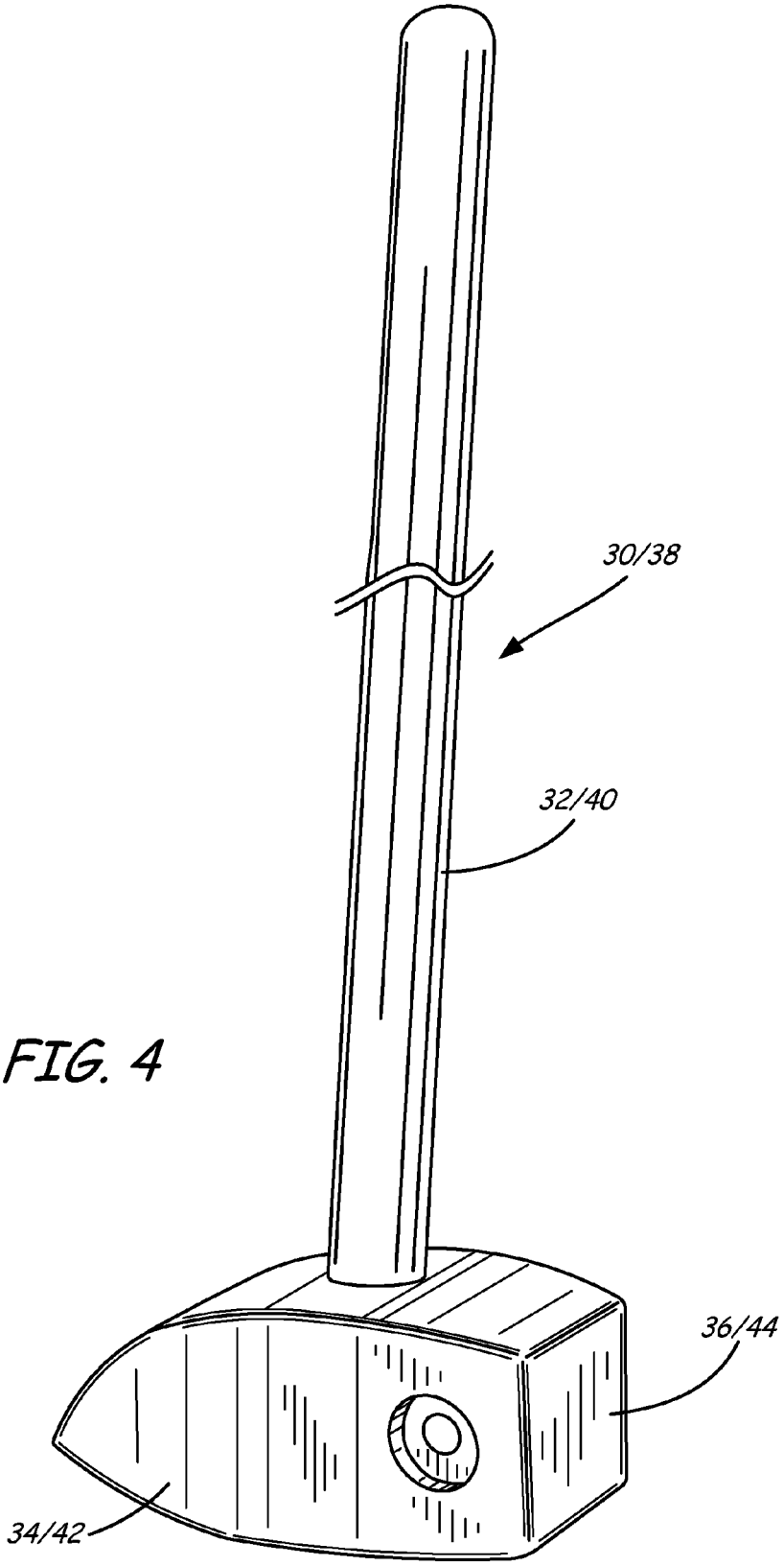
FIG. 4 is an isometric view of a ball-striking mallet for use in the playing the game.

A first ball-striking mallet 30 is provided for the first team. The first ball-striking mallet is likewise colored (e.g., red) or bears some other indicia indicating that it is the mallet associated with the first team. The first mallet has a handle 32 and a head 34 attached to one end of the handle 32. The head 34 has a primary ball-striking surface 36, but other surfaces of the mallet may also be used in an attempt to strike a ball during game play, if desired by a player. A second ball striking mallet 38 is provided for the second team, and is likewise colored (e.g., white) or bears some other indicia to associate it with the second team. The second mallet 38 has a handle 40 with a head 42 attached to one end of the handle 40. The head 42 has a primary ball-striking surface 44, although like the head 34 of the first mallet 30, other surfaces on the mallet may also be used in an attempt to strike a ball during game play. In one embodiment, each mallet has a length of approximately 29 inches. An exemplary configuration of a mallet for use in the game is illustrated in FIG. 4.

The game components also include a pair of boundary blocks 46A and 46B. In one embodiment, the boundary blocks are square cubes wherein each side, for example, measures 2.275 inches and are of the same color or other indicia.

Figure 5:
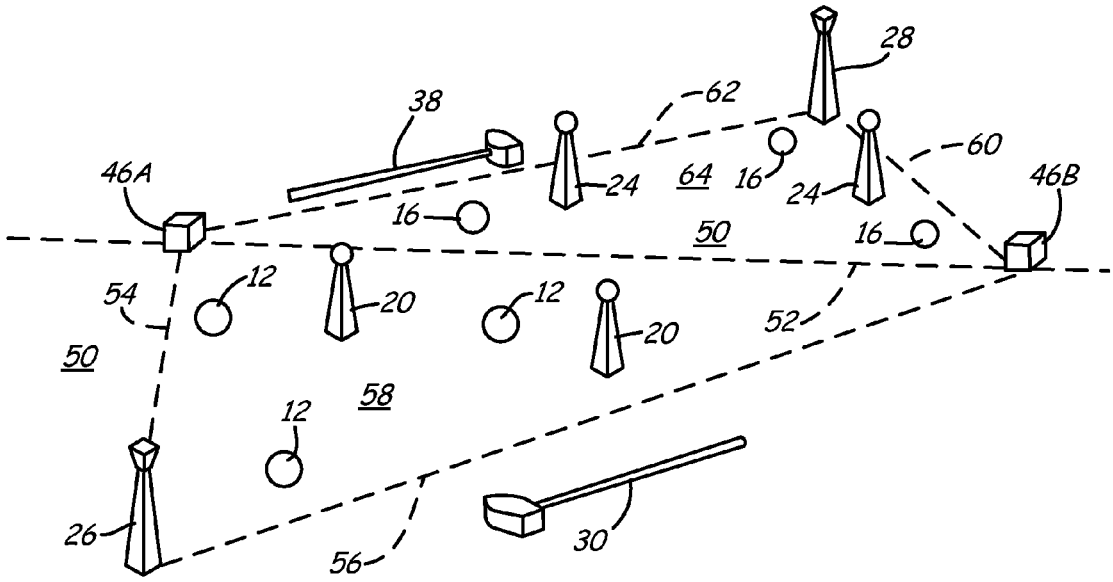
FIG. 5 is a schematic illustration of game components laid out in one possible configuration on a playing surface for playing the game.

FIG. 5 illustrates one exemplary arrangement for laying out the game components on a playing surface for playing the game. As noted above, the game is played by two teams. A team may comprise any number of players (at least one). When a team has more than one player, players on that team alternate turns during game play.

To initiate game play, the players select a playing surface 50 for playing the game. Such a playing surface may be a lawn, park area or even a parking lot. The playing surface need not be level or free from other elements (e.g., trees, bushes, benches, etc.). In addition, it is contemplated that the game could be played indoors, such as on carpeting or another surface within a structure. The boundary blocks 46A and 46B are laid out on the playing surface in a spaced apart configuration, thereby defining a boundary line 52 therebetween. The taller game towers 26 and 28 are then placed on the playing surface 50 in an upright configuration at points spaced equally from each side of the boundary line 52 and between boundary blocks 46A and 46B. Doing so thus creates two triangular set-up territories which are mirror images of one another in size and layout, as defined by the boundary line 52 and lines 54 and 56 (for a triangular first team set-up territory 58) and the boundary line 52 and lines 60 and 62 (for a triangular second team set-up territory 64).

The first set 18 of the shorter game towers 20 are disposed within the triangular set-up territory 58 of the first team on the playing surface 50. The first set 10 of the first balls 12 of the first team are then laid out within the triangular first set-up territory 58 of the first team on the playing surface. In one embodiment, this is done by a player from the first team. As will be appreciated as the game rules are understood, the layout of balls and shorter towers within a team's set-up territory can help define that team's strategy during game play. In one embodiment, each ball of the first team must be within one length of that team's mallet from one of the towers of the first team.

The second set 22 of the shorter game towers 24 are disposed within the triangular second set-up territory 58 of the first team on the playing surface 50. The second set 14 of the first balls 16 of the second team are then laid out within the triangular second set-up territory 64 of the first team on the playing surface 50. In one embodiment, this is done by a player from the second team. As will be appreciated as the game rules are understood, the layout of balls and shorter towers within a team's set-up territory can help define that team's strategy during game play. In one embodiment, each ball of the second team must be within one length of that team's mallet from one of the towers of the second team.

Thus, FIG. 5 illustrates on example of how the balls and towers of the first and second teams may be disposed on the playing surface 50 for playing the game. Once the game components are set up on the playing surface, game play can begin.

In one embodiment, the team that is first to set up its game components (e.g., the first team) begins play. The determination of which team would be first to set up its game components can be conducted by chance, such as by flipping a coin. If a series of games are being played in sequence, the team which would be first in a subsequent game, in one embodiment, would be the team which lost the previous game.

The beginning player on the team that is starting play then takes a turn. A player's turn begins when the player attempts to strike one of that player's own balls with that team's mallet. In game parlance, that game ball then becomes the "HIT MAN" for that player, for that turn. That player, when striking that ball, aims for one of the opponent's balls or one of the opponent's shorter game towers. Accordingly, each turn comprises a player on a team attempting to strike one of that team's balls with that team's mallet in an attempt to contact one of the other team's balls or towers. Any number of events may occur as a consequence of that turn.

If the struck ball contacts and knocks over one of the other teams shorter towers, the contacted shorter tower is removed from the playing surface and that player receives another turn. That player can then again attempt to strike that ball, or any of the other of that player's team balls, in an attempt to contact one of the opponent's balls or one of the opponent's shorter game towers. Upon this continued turn, if the then struck ball contacts and knocks over the other one of the other team's shorter towers, that second contacted shorter tower is removed from the playing surface, and that player receives yet another turn. Since both of the opponent's shorter towers have been removed from the field of play, the player in this continued turn can now attempt to attack (i.e., contact and knock over with any one of that player's balls) the other team's taller game tower. Alternatively, the player could aim any one of that player's team's balls at one of the opponent's balls. However, if the player then attempts to strike another one of its own team's balls and that struck ball contacts and knocks over the other team's taller tower, the game is over and the player's team is declared the winner of that game (without the other team even having had a turn). That outcome, while possible, is rather unusual. Typically, a player will not possess the necessary skill and luck to knock over all of the other team's shorter game towers and then the other team's taller game tower in one series of sequential turns.

If, prior to removal of all of the other team's shorter towers from the playing surface, a player's struck ball fails to contact and knock over one of the other team's shorter towers, that player's turn is over. In addition, if after the removal of all of the other team's shorter towers from the playing surface, the struck ball fails to contact and knock over the other team's taller tower, that player's turn is over. A player's turn is also over when that player's struck ball contacts one of the other team's balls or one of that player's own team's balls. When one of the other team's balls is contacted, the contacted ball is removed from the playing surface. A player's turn is also over when the struck ball contacts and knocks over one of the shorter towers of that player's team, and that contacted shorter tower is then removed from the playing surface. As may be appreciated from above, a player's turn is also over if the player's struck ball contacts nothing, or if the player fails to even strike that player's own ball during an attempted turn. The consequence of a turn being over is that play then shifts to the other team, and one of its players may then take a turn by attempting to strike one of that player's team's balls with that team's mallet in an attempt to contact one of the other team's balls or towers.

As noted above, the game may be declared over when all of the one team's towers have been contacted and knocked over, with the other team being the winner of that game. Another way to win the game is for one team to be the first to contact all of the other team's balls with a struck ball. This game can also be lost while a team is on offense with the other team declared the winner if, prior to removal of all of the other team's shorter towers from the playing surface, a player's struck ball contacts and knocks over the other team's taller tower. Another event that would result in losing the game when a player is striking its own team's ball is if that struck ball contacts and knocks over that player's own team's taller tower.

Stated another way, the play of game may be described as follows:

If the player's "HIT MAN" ball misses an opponent's ball or an opponent's soldier, the player's turn is then over, and the opponent gets to take a turn.

If the player's "HIT MAN" ball hits one of the opponent's balls, that opponent's ball is then removed from the playing surface of the game and the player's turn is over.

If the player's "HIT MAN" ball hits one of the opponent's "soldiers", that soldier is "captured." That player is then entitled to a "BONUS" which means the player gets another turn. The player can then select any of the player's team's balls and strike it with the mallet, turning the struck ball into the player's current "HIT MAN" ball. The player aims for one of the opponent's balls, or the opponent's other soldier. Also again, if a player's current "HIT MAN" ball misses one of the opponent's balls or the opponent's other soldier, the player's turn is over.

However, if the player hits another ball of the opponent with the current "HIT MAN" ball, that opponent's ball is removed from the game, and the player's turn is over.

Also, if the player's "HIT MAN" ball hits the other soldier of the opponent, that soldier is then captured. The player then gets an additional "BONUS", which means the player gets another turn. This means the player can select any of the player's balls and strike it with the mallet, turning the struck ball into the player's current "HIT MAN" ball. The player aims for either the opponent's kingpin or one of the opponent's balls.

If in this second "BONUS", if the player's current "HIT MAN" ball misses one of the opponent's balls or the opponent's kingpin, the player's turn is over.

If in this second "BONUS", the player's current "HIT MAN" ball hits one of the opponent's balls, that opponent's ball is removed from the game and the player's turn is over.

If in this second "BONUS", the player's current "HIT MAN" ball hits the opponent's kingpin, the game is over and the player's team has won.

If a ball struck by a player hits one of that player's own soldiers, that soldier is also considered to be captured. If a player's own ball strikes that player's own kingpin, the game is over and the opponent wins that game.

Accordingly, the ultimate goal of playing the game is to be the first team to knock over both of the opposing team's shorter game towers and then the opposing team's taller game tower, or, to be the first team to contact all three of the opposing team's balls. In the case of the former, both of the opposing team's shorter game towers must be knocked over before the opposing team's taller game tower can be attacked. Whenever a shorter game tower is knocked over and whenever an opponent's ball is contacted by a struck ball, those game components are removed from the playing surface. However, if a tower of either team on the playing surface is knocked over by any event other than being struck by a ball during a player's turn, that tower is reset upright in its original position for continued game play. In addition, once a game has begun, the natural limits of the playing surface are the only boundaries of the game.

In one embodiment, each team's shorter game towers are placed anywhere within that team's set-up territory, and then each team's balls are placed one mallet length from any of that team's shorter towers. In another embodiment, a team's balls are placed within one mallet length of any tower of that team.

A game comprising these components and the explained methods of play does not involve complex playing pieces or rules, and can thus be enjoyed by players of many ages and ability. As noted above, however, during a turn each player is allowed only one attempt to hit one of that player's team's balls. If the player misses the ball, then that player's turn is over.

The methods of play described above relate to the playing of a single game. Teams may agree how many games it will take to win a "match" between the teams. For example, in one embodiment of game play, the winner of a match is the first team to win five games.

This disclosure is provided to explain and disclose my novel game concepts. Many other novel advantages, features, and relationships will become apparent from this disclosure. The illustrations and the description exemplify illustrative embodiments. In all cases, this disclosure presents the disclosed subject matter by way of representation and not limitation. It should be understood that numerous other modifications and embodiments can be devised by those skilled in the art which fall within the scope and spirit of the principles of this disclosure.

The invention claimed is:

1. A method for playing a field game comprising:

selecting a playing surface for the game;

placing two markers on the playing surface at spaced locations to form a boundary line;

placing a first team kingpin tower in an upright position on the playing surface at a first point spaced from the boundary line in a first direction to form a first set-up territory for a first team having an area defined by the two markers and the first team kingpin tower;

placing a second team kingpin tower in the upright position on the playing surface at a second point spaced from the boundary line in a second direction opposite the first direction to form a second set-up territory for a second team having an area defined by the two markers and the second team kingpin tower;

arranging a plurality of first team balls and a plurality of first team soldier towers on the playing surface within the first set-up territory;

arranging a plurality of second team balls and a plurality of second team soldier towers on the playing surface within the second set-up territory; and alternating play turns between the first team and the second team until one of the first team and second team is declared a winner, wherein an initial play turn comprises a first player of the first team using a first team mallet to attempt to strike one of the plurality of first team balls, in a further attempt to establish contact between the struck ball and any of the plurality of second team balls or second team soldier towers, with the initial play turn ending as defined by turn ending rules, wherein all of the following turn ending rules is applicable in the method of playing the field game:

a) when the first team mallet fails to strike one of the plurality of first team balls, the initial play turn ends and the second team takes a subsequent play turn following the turn ending rules;

b) when the first team mallet strikes one of the plurality of first team balls, and when the struck ball fails to contact one of the plurality of first or second team balls and fails to contact one of the plurality of first or second team soldier towers and fails to contact the first or second team kingpin tower, the initial play turn ends and the second team takes a subsequent play turn following the turn ending rules;

c) when the first team mallet strikes one of the plurality of first team balls, and when the struck ball contacts one of the plurality of second team balls, the contacted second team ball is removed from play; when another of the plurality of second team balls remains in play, the initial play turn ends and the second team takes a subsequent play turn following the turn ending rules;

d) when the first team mallet strikes one of the plurality of first team balls, and when the struck ball contacts one of the plurality of second team balls, the contacted second team ball is removed from play; when none of the plurality of second team balls remains in play, the first team is declared the winner;

e) when the first team mallet strikes one of the plurality of first team balls, and when the struck ball contacts one of the plurality of second team soldier towers, the contacted second team soldier tower is removed from play, and the first player takes a bonus play turn following the turn ending rules;

f) when the first team mallet strikes one of the plurality of first team balls, and when the struck ball contacts one of the plurality of first team soldier towers, the contacted first team soldier tower is removed from play, the initial play turn ends and the second team takes a subsequent play turn following the turn ending rules;

g) when the first team mallet strikes one of the plurality of first team balls, and when the struck ball contacts the second team kingpin tower when there is at least one second team soldier tower in play, the second team is declared the winner;

h) when the first team mallet strikes one of the plurality of first team balls, and when the struck ball contacts the second team kingpin tower when there is no second team soldier tower in play, the first team is declared the winner;

i) when the first team mallet strikes one of the plurality of first team balls, and when the struck ball contacts another of the plurality of first team balls, the initial play turn ends and the second team takes a subsequent play turn following the turn ending rules; and j) when the first team mallet strikes one of the plurality of first team balls, and when the struck ball contacts the first team kingpin tower, the second team is declared the winner.

2. The method of claim 1 wherein:

arranging a plurality of first team balls and a plurality of first team soldier towers on the playing surface within the first set-up territory comprises placing each of the plurality of first team balls within one length of the first team mallet from at least one of the plurality of first team soldier towers; and arranging a plurality of second team balls and a plurality of second team soldier towers on the playing surface within the second set-up territory comprises placing each of the plurality of second team balls within one length of a second team mallet from at least one of the plurality of second team soldier towers.

3. The method of claim 1 wherein after the initial play turn begins, there are no boundaries of the game other than natural limits of the playing surface.

4. The method of claim 1 wherein any of the plurality of first or second kingpin or soldier towers is reset in the upright position on the playing surface when the tower is knocked over by an event other than being struck by a ball during a play turn.

5. The method of claim 1 wherein the first and second set-up territories are generally mirror images of one another in size and layout as a result of placing the first and second team kingpin towers.

6. The method of claim 1 wherein contact by the struck ball with one of the first or second kingpin tower or one of the plurality of first or second soldier towers knocks over the tower.

7. A method for playing a field game comprising:

selecting a playing surface for the game;

placing two markers on the playing surface at spaced locations to form a boundary line;

placing a first team kingpin tower in an upright position on the playing surface at a first point spaced from the boundary line in a first direction to form a first set-up territory for a first team having an area defined by the two markers and the first team kingpin tower;

placing a second team kingpin tower in the upright position on the playing surface at a second point spaced from the boundary line in a second direction opposite the first direction to form a second set-up territory for a second team having an area defined by the two markers and the second team kingpin tower;

arranging a plurality of first team balls and a plurality of first team soldier towers on the playing surface within the first set-up territory;

arranging a plurality of second team balls and a plurality of second team soldier towers on the playing surface within the second set-up territory; and alternating play turns between the first team and the second team until one of the first team and second team is declared a winner, wherein a play turn comprises a player of one of the first and second teams using a player's team mallet to attempt to strike one of the plurality of player's team balls, in a further attempt to establish contact between the struck ball and one of the plurality of opponent team balls or opponent team soldier towers, with the game ending at least when any of these events occurs:

a) when the player's team mallet strikes one of the plurality of player's team balls, and when the struck ball contacts the opponent team kingpin tower when there is at least one opponent team soldier tower in play, the opponent team is declared the winner; and b) when the player's team mallet strikes one of the plurality of player's team balls, and when the struck ball contacts the opponent team kingpin tower when there is no opponent team soldier tower in play, the player's team is declared the winner.

8. The method of claim 7 wherein the play turn also ends at least as follows: when the player's team mallet fails to strike one of the plurality of player's team balls, the play turn ends and the opponent team takes a subsequent play turn.

9. The method of claim 7 wherein the play turn also ends at least as follows: when the player's team mallet strikes one of the plurality of player's team balls, and when the struck ball fails to contact one of the plurality of first or second team balls and fails to contact one of the plurality of first or second team soldier towers and fails to contact the first or second team kingpin tower, the play turn ends and the opponent team takes a subsequent play turn.

10. The method of claim 7 wherein the play turn also ends at least as follows: when the player's team mallet strikes one of the plurality of player's team balls, and when the struck ball contacts one of the plurality of opponent team balls, the contacted opponent team ball is removed from play; when another of the plurality of opponent team balls remains in play, the play turn ends and the opponent team takes a subsequent play turn.

11. The method of claim 7 wherein the play turn also ends at least as follows: when the player's team mallet strikes one of the plurality of player's team balls, and when the struck ball contacts one of the plurality of opponent team balls, the contacted opponent team ball is removed from play; when none of the plurality of opponent team balls remains in play, the player's team is declared the winner.

12. The method of claim 7 wherein the play turn also ends at least as follows: when the player's team mallet strikes one of the plurality of player's team balls, and when the struck ball contacts one of the plurality of opponent team soldier towers, the contacted opponent team soldier tower is removed from play, and the player takes a bonus play turn.

13. The method of claim 7 wherein the play turn also ends at least as follows: when the player's team mallet strikes one of the plurality of player's team balls, and when the struck ball contacts one of the plurality of player's team soldier towers, the contacted player's team soldier tower is removed from play, the play turn ends and the opponent team takes a subsequent play turn.

14. The method of claim 7 wherein the play turn also ends at least as follows: when the player's team mallet strikes one of the plurality of player's team balls, and when the struck ball contacts another of the plurality of player's team balls, the play turn ends and the opponent team takes a subsequent play turn.

15. The method of claim 7 wherein the play turn also ends at least as follows: when the player's team mallet strikes one of the plurality of player's team balls, and when the struck ball contacts the player's team kingpin tower, the opponent team is declared the winner.

16. A method for playing a field game comprising:

selecting a playing surface for the game;

placing two markers on the playing surface at spaced locations to form a boundary line;

placing a first team kingpin tower in an upright position on the playing surface at a first point spaced from the boundary line in a first direction to form a first set-up territory for a first team having an area defined by the two markers and the first team kingpin tower;

placing a second team kingpin tower in the upright position on the playing surface at a second point spaced from the boundary line in a second direction opposite the first direction to form a second set-up territory for a second team having an area defined by the two markers and the second team kingpin tower;

arranging a plurality of first team balls and a plurality of first team soldier towers on the playing surface within the first set-up territory;

arranging a plurality of second team balls and a plurality of second team soldier towers on the playing surface within the second set-up territory; and alternating play turns between the first team and the second team until one of the first team and second team is declared a winner, wherein an initial play turn comprises a first player of the first team using a first team mallet to attempt to strike one of the plurality of first team balls, in a further attempt to establish contact between the struck ball and one of the plurality of second team balls or second team soldier towers, with the initial play turn ending at least when any of the following events occurs:

a) when the first team mallet strikes one of the plurality of first team balls, and when the struck ball contacts one of the plurality of second team balls, the contacted second team ball is removed from play; when another of the plurality of second team balls remains in play, the initial play turn ends and the second team takes a subsequent play turn; and b) when the first team mallet strikes one of the plurality of first team balls, and when the struck ball contacts one of the plurality of second team balls, the contacted second team ball is removed from play; when none of the plurality of second team balls remains in play, the first team is declared the winner.

17. The method of claim 16 wherein the initial play turn also ends when the following events occurs: when the first team mallet strikes one of the plurality of first team balls, and when the struck ball contacts the first team kingpin tower, the second team is declared the winner.

18. The method of claim 16 wherein the initial play turn also ends when the following events occurs: when the first team mallet strikes one of the plurality of first team balls, and when the struck ball fails to contact one of the plurality of first or second team balls and fails to contact one of the plurality of first or second team soldier towers and fails to contact the first or second team kingpin tower, the initial play turn ends and the second team takes a subsequent play turn.

19. The method of claim 16 wherein the initial play turn also ends when the following events occurs: when the first team mallet strikes one of the plurality of first team balls, and when the struck ball contacts one of the plurality of second team soldier towers, the contacted second team soldier tower is removed from play, and the first player takes a bonus play turn.

20. The method of claim 16 wherein the initial play turn also ends when the following events occurs: when the first team mallet strikes one of the plurality of first team balls, and when the struck ball contacts one of the plurality of first team soldier towers, the contacted first team soldier tower is removed from play, the initial play turn ends and the second team takes a subsequent play turn.

* * * * *